United States Patent [19]

Steinwart et al.

[11] 4,174,693

[45] Nov. 20, 1979

[54] FUEL INJECTION SYSTEM HAVING PRESSURIZED DAMPING MEANS

[75] Inventors: Johannes Steinwart, Obersulm-Willsbach; Gerhard Maurhoff; Armin Bauder, both of Neckarsulm, all of Fed. Rep. of Germany

[73] Assignee: Audi NSU Auto Union Aktiengesellschaft, Fed. Rep. of Germany

[21] Appl. No.: 859,241

[22] Filed: Dec. 9, 1977

[30] Foreign Application Priority Data

Dec. 14, 1976 [DE] Fed. Rep. of Germany ..... 2656538

[51] Int. Cl.[2] ..... F02M 39/00; F02N 9/00; F02M 37/06

[52] U.S. Cl. ..... 123/139 AW; 123/139 ST; 123/179 L; 261/50 A

[58] Field of Search ..... 123/139 AW, 139 ST, 123/179 L, 119 R; 261/50 A, 50 AA

[56] References Cited

U.S. PATENT DOCUMENTS

| | | | |
|---|---|---|---|
| 3,703,888 | 11/1972 | Eckert et al. | 123/139 AW |
| 3,713,430 | 1/1973 | Knapp et al. | 123/139 AW |
| 3,880,125 | 4/1975 | Kammerer et al. | 123/139 AW |
| 3,930,481 | 1/1976 | Eckert | 123/139 AW |
| 3,983,850 | 10/1976 | Stumpp et al. | 123/139 AW |
| 4,026,259 | 5/1977 | Meyerdierks et al. | 123/139 AW |

FOREIGN PATENT DOCUMENTS

| | | | |
|---|---|---|---|
| 2249235 | 4/1974 | Fed. Rep. of Germany | 123/139 AW |
| 2547645 | 5/1977 | Fed. Rep. of Germany | 123/139 AW |

*Primary Examiner*—Charles J. Myhre
*Assistant Examiner*—P. S. Lall
*Attorney, Agent, or Firm*—Kane, Dalsimer, Kane, Sullivan and Kurucz

[57] ABSTRACT

A fuel injection system for a mixture compressing spark ignition internal combustion engine includes means for injection of fuel into the air intake of the engine. A fuel metering valve dispenses to one or more injection jets a quantity of fuel related to the quantity of air flowing through the intake. An adjustable throttle valve is in the air intake as well as an air flow measuring element which is movable against a restoring force in accordance with the quantity of air flowing through the intake. The measuring element is arranged to actuate a control element of the fuel metering valve. A damping device having a damping element connected to the measuring element is movable to displace fluid between two damping chambers through a throttling passage. One damping chamber is connected to a fuel pump which delivers fuel to the metering valve while the second damping chamber is connected to a discharge port through a thermally controlled outlet valve. A metering trap chamber downstream of the outlet valve is provided with means for emptying the trap chamber after operation.

9 Claims, 3 Drawing Figures

FUEL INJECTION SYSTEM HAVING PRESSURIZED DAMPING MEANS

BACKGROUND OF THE INVENTION

This invention relates to a fuel injection system for a mixture compressing spark ignition internal combustion engine having means for injection of fuel into the air intake of the engine, the air intake including an adjustable throttle valve and an air flow measuring element which is movable against a restoring force in accordance with the quantity of air flowing through the intake the measuring element being arranged to actuate the control element of a fuel metering valve for dispensing to one or more injection jets a quantity of fuel related to the quantity of air. In such systems a situation may arise at temperatures below freezing point whereby, by virtue of the water contained in the fuel, the control piston of the metering valve freezes solid, so that a cold start is made considerably more difficult and in some cases even impossible. As a result of the low negative pressures obtaining in the air intake during the starting operation, the measuring element does not generate sufficient force to free the control piston.

SUMMARY OF THE INVENTION

It is an object of the invention to provide a fuel injection system of the type referred to having means for positively freeing the control piston in the event of such freezing.

Broadly stated the invention consists in a fuel injection system for a mixture compressing spark ignition internal combustion engine having means for injection of fuel into the air intake of the engine, the air intake including an adjustable throttle valve and an air flow measuring element which is movable against a restoring force in accordance with the quantity of air flowing through the intake the measuring element being arranged to actuate the control element of a fuel metering valve for dispensing to one or more injection jets a quantity of fuel related to the quantity of air, and being coupled to a damping device having a damping element movable to displace fluid between two damping chambers via a throttling passage, one damping chamber being connected to a fuel pump which delivers fuel to the metering valve, while the second damping chamber is connected to a discharge port via a thermally controlled outlet valve.

When the outlet valve is closed, the damping device functions as a normal hydraulic damper, with the same pressure in both chambers when the device is static, and the damping effect being achieved by displacement of the fluid from one chamber into the other by virtue of movement of the damping element. In the event of a cold start, the outlet valve is opened briefly, depending upon the temperature, so that the fuel pressure in the second damping chamber is diminished and the fuel pressure in the first damping chamber causes movement of the damping element and thus also of the control piston which is operatively connected to the damping element. This movement of the damping element causes an opening movement of the metering valve, and thus provides enrichment of the fuel air mixture for cold starting. At extremely low ambient temperatures, if the control piston should have frozen solid, then the considerable difference in pressure between the two damping chambers is normally sufficient to break loose the control piston. If the outlet valve is closed again after the control piston has been freed, then under the action of the restoring force acting on the measuring element, the damping element returns to its datum position as determined by the position of the measuring element under the pressure conditions obtaining in the intake duct.

According to a preferred feature of the invention the system includes a metering trap chamber downstream of the outlet valve and provided with means for emptying the trap chamber after operation. Conveniently the trap chamber has at its lowest point an adjustable drain nozzle through which the fuel can flow back into the tank.

As a result of the movement of the control piston caused by the displacement of the damping element, more fuel is fed to the injection jet or jets than normally corresponds to the quantity of air being drawn in, which automatically produces the required fuel ratio enrichment for cold starting. However, when the outlet valve is opened, the damping element would tend to move, under the pressure of the fuel in the first damping chamber, into its extreme position corresponding to the full load position of the control piston. Therefore according to another preferred feature of the invention the volume of the trap chamber is made smaller than the maximum volume of the second damping chamber. Consequently, after any air contained in the trap chamber has been displaced by the transferred fuel, a finite volume of fuel is left in the second damping chamber which acts as a hydraulic lock and prevents the damping element moving to the extreme position which corresponds to the full load.

The cross-section of the drain nozzle from the trap chamber is preferably so adjusted that it is smaller than the cross-section of the throttling connection between the damping chambers, so that even when the outlet valve is open, after some time an equal pressure will obtain in the damping chambers and the restoring force is now capable of returning the damping element and with it the measuring element and the control piston to the datum position which corresponds to the quantity of air flowing through the intake duct. The ventilation of the trap chamber should therefore be so contrived that it closes immediately and only when the trap is filled with pressurized fuel. If the outlet valve is closed, then the fuel pressure in the trap chamber is diminished via the drain nozzle, the trap venting arrangement comes into operation and all the fuel in the trap chamber can flow into the tank through the drain nozzle, so ensuring that at the next cold start the trap is empty. The line linking the drain nozzle to the tank can therefore be used also for venting the tank.

The outlet valve may conveniently be in the form of an electromagnetic valve, in the circuit of which there is a time switch. This time switch preferably operates also in accordance with the engine temperature, such that the lower the ambient temperature is, the longer it will keep the outlet valve open, to produce the aforementioned fuel enrichment for cold starting purposes.

The damping element may be a single-vane damper arranged to pivot within a housing shaped like a segment of a circle. Alternatively, the damping element may be a two-vane damper, each of the vanes being pivotable in a segment shaped housing and each separating first and second damping chambers, the two first damping chambers being connected to the fuel pump while the two second damping chambers are connected to each other and to the outlet valve.

The invention may be performed in various ways and one specific embodiment with a number of possible modifications will now be described by way of example with reference to the accompanying drawings:

DETAILED DESCRIPTION

Figure 1:
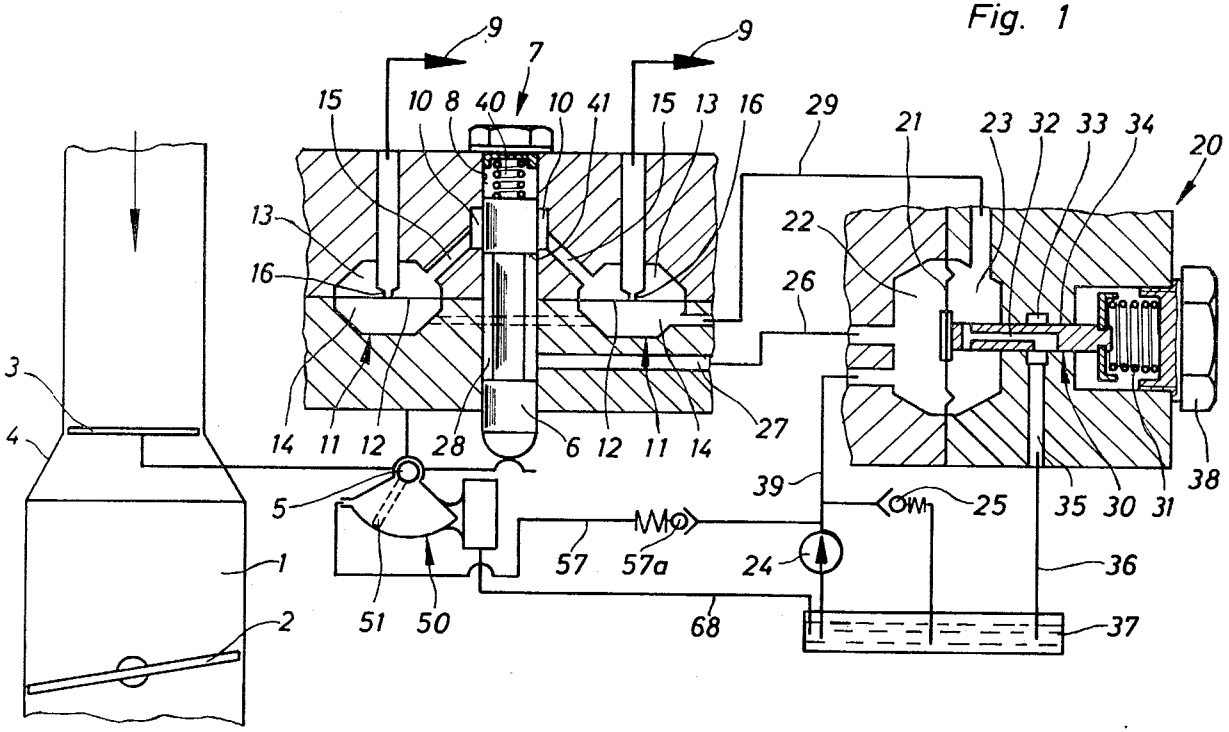
FIG. 1 is a diagrammatic view, partly in cross section, of a fuel injection system according to the invention.

FIG. 1 illustrates an air inlet duct 1 of a mixture-compressing spark-ignition internal combustion engine, including an adjustable throttle valve 2 and a measuring element 3 which moves according to the quantity of air flowing through in the direction of the arrow. The measuring element 3 is formed as a baffle plate and is disposed in a conical portion 4 of the inlet duct 1. The baffle plate 3 is pivotally mounted on a shaft 5 and acts on the displaceable control piston 6 of a fuel metering valve 7. The control piston 6 is disposed in a cylindrical valve bore 8 in the wall of which are a number of control slots 10 corresponding to the number of injection jets 9, as indicated by arrows. Downstream of each control slot 10 is a diaphragm type constant pressure valve 11 which has two chambers 13 and 14 separated from each other by a diaphragm 12. Each chamber 13 is connected via a passage 15 to the relevant control slot 10 and via a valve aperture 16 controlled by the diaphragm 12 to one of the injection jets 9. Common to all the constant pressure valves 11 is a differential pressure regulating valve 20 having two chambers 22 and 23 separated from each other by a diaphragm 21. The chamber 22 is supplied with fuel by an electrically driven fuel pump 24, at system pressure which is determined by a system pressure maintaining valve 25. The chamber 22 is moreover connected via a line 26 and a passage 27 to an annular groove 28 in the control piston 6 of the fuel metering valve 7. The second chamber 23 of the differential pressure regulating valve 20 is connected by a line 29 to the second chambers 14 of all the constant pressure valves 11. The pressure in the chamber 23, which determines the pressure differential at the metering valve 7, is regulated by a valve element 30 which is urged by a spring 31 against the diaphragm 21 of the differential pressure regulating valve 20 and which has, communicating with the chamber 23, a bore 32 which according to the position of the valve body 30, provides a greater or small opening into an annular groove 33 in the wall of the bore 34 which houses the valve body 30. The annular groove 33 is connected by a passage 35 and a return line 36 to the fuel tank 37. The initial stress in the spring 31, which can be adjusted by means of a screw 38, determines the value of the differential pressure at the metering valve 7.

The fuel delivered by the fuel pump 24 passes through the line 39 into the first chamber 22 of the differential pressure regulating valve 20 and from there through the line 26 and the passage 27 into the annular groove 28 of the control piston 6. The control piston 6 is displaced upwardly out of the inoperative position shown in the drawings by the baffle plate 3, in accordance with the amount by which the plate is deflected by the quantity of air flowing through the intake duct 1, and against a restoring force generated (in this example) by a spring 40. The control edge 41 thus exposes the control slots 10 to a greater or lesser degree in proportion to the deflection of the battle plate 3. The fuel now passes through the passages 15 into the first chambers 13 of the constant pressure valves 11, whence it flows through the valve apertures 16 to the associated injection jets 9.

Figure 2:
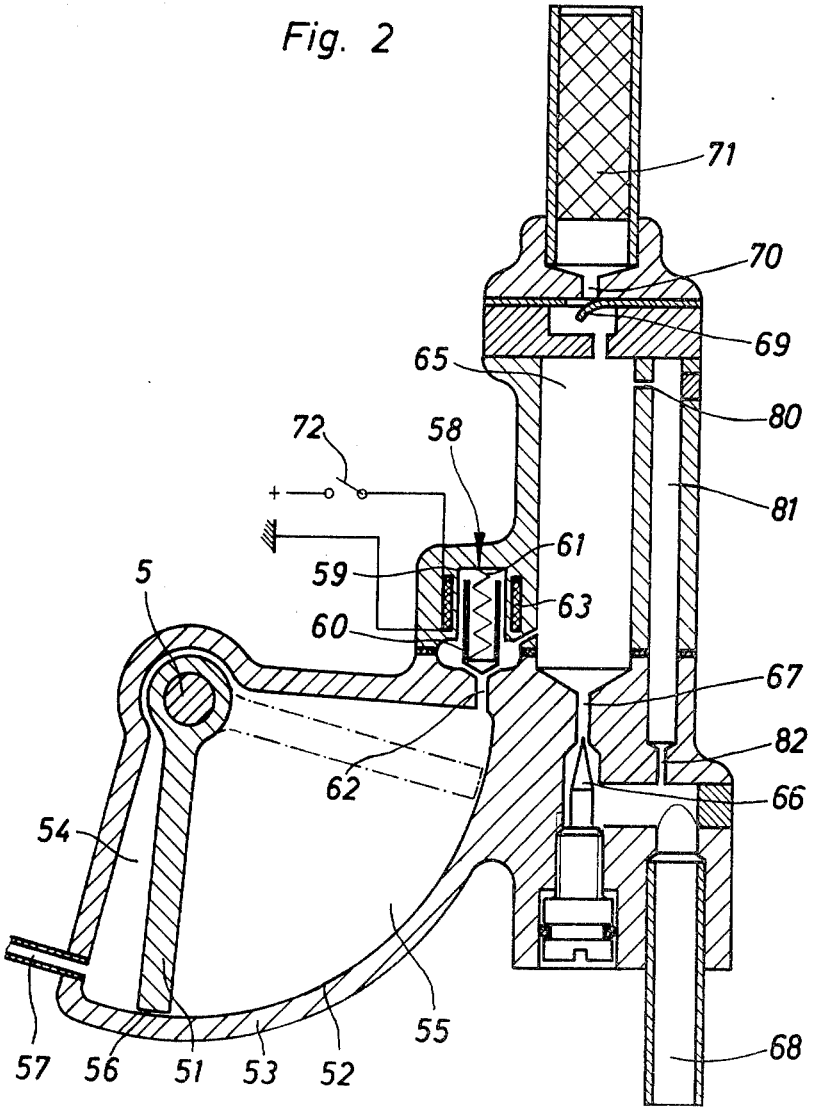
FIG. 2 is a sectional side elevation on an enlarged scale of the damping device of the injection system shown in FIG. 1.

To avoid the air sensing baffle plate 3 being deflected by sudden oscillations of the current of indrawn air in the suction pipe 1 which would result in incorrect metering of the fuel, the baffle plate 3 is coupled to a damping device 50 which is shown in detail in FIG. 2. The damping device 50 has a damper vane 51 which is fixedly mounted on the pivot shaft 5 for the baffle plate 3 and which is pivotable in the damper housing 53, in a chamber 52 which in cross-section has the shape of a segment of a circle, the vane 51 subdividing this chamber into two damper chambers 54 and 55. The damper chambers 54 and 55 communicate with each other via a throttling passage or gap 56 between the edge of the damper vane 51 and the adjacent walls of the chamber 52. The damper chamber 54 is connected by a line 57 to the pressure side of the fuel pump 24. During operation, the chamber 52 is completely filled with fuel, so that under static conditions the same pressure obtains in the damper chambers 54, 55. In the inoperative position shown in FIG. 1 the damper vane 51 is urged by the effect of the spring 40 into one extreme position, shown in FIG. 1. If, during operation, the baffle plate 3 is deflected, this will cause pivotal movement of the damper vane 51 which can occur only by displacement of liquid from the second damper chamber 55 into the first damper chamber 54 through the aforementioned gap 56. In consequence, the movement of the baffle plate 3 is damped. It will be appreciated that damping also takes place if the baffle plate 3 is moved in the opposite direction from its deflected position back towards its inoperative position. A check valve **57*a* in the line 57 prevents the damper chambers 54, 55** emptying when the system is in its inoperative condition.

Connected to the second damper chamber 55 is an outlet valve 58, having a valve body 60, movable in a bore 59 to block an outlet orifice 62 under the action of a spring 61. In this illustrated example the outlet valve 58 is in the form of an electromagnetic valve, with a coil 63 which, when excited, attracts the magnetic valve body 60 against the action of a spring 61, so that the outlet orifice 62 is opened. Downstream of the outlet valve 58 is a trap chamber 65 which has at its lowest point and adjustable by a jet needle 66, a draining nozzle 67 which is connected by a return line 68 to the fuel tank 37. The trap 65 can be ventilated by a vent opening 70 controlled by a tongue or flap valve 69. The vent opening 70 is connected to the atmosphere by its own air filter 71 or by the main air filter (not shown) on the intake pipe 1. Disposed in the circuit of the magnetic winding 63 is a temperature-time switch 72, i.e., a time switch with an adjustable set interval governed automatically by the sensed temperature.

In the event of a cold start, the outlet valve 58 is opened by closing of the switch 72, so that the pressure in the second damping chamber 55, which has built up by reason of the delivery from the fuel pump which is set in motion during the starting process, is reduced and the fuel pressure in the first damper chamber 54 is then capable of pivoting the damper vane 51 and of thereby displacing the control piston 6, resulting in a quantity of fuel which is over-proportional in relation to the quantity of air drawn in, and therefore fuel enrichment for the cold start. If the control piston 6 is frozen solid, then the force exerted on the damper vane 51 is normally sufficient to break loose the control piston 6. The fuel displaced from the damper chamber 55 can flow through the opening 62 into the trap 65. This breaking loose movement of the damper vane 51 occurs rapidly according to the pressure build-up of the pump, accompanied by a compression and partial escape of the volume of air contained in the trap 65. The tongue valve 69 closes the venting aperture 70 no later than when it is reached by the fuel. THe volume of the trap 65 is considerably less than the maximum volume of the second damper chamber 55, in other words the volume of the damper chamber 55 has when the damper vane 51 is in its inoperative position shown in FIG. 1. In consequence, the damper vane 51 cannot be pivoted into its extreme position which is shown in broken lines in FIG. 2. This position corresponds to the full load position of the control piston 6 and the result of any pivoting into this extreme position would be that an over-rich non-ignitable mixture of fuel and air would be formed, since the quantity of fuel dispensed does not in any way correspond to the quantity of air drawn in. The fuel can flow back from the trap 65 through the drain nozzle 67 and the line 68 into the fuel tank 37. The cross-section of this drain nozzle 67 is considerably smaller than the cross-section of the gap 56, so that the flow of fuel through the drain nozzle 67 does not cause any reduction in the pressure in the damper chamber 55. Instead, at or before the moment when the trap 65 is filled with fuel from the damper chamber 55, there is equality of pressures in the damper chambers 54 and 55, so that the spring 40 is now again in a position to pivot the damper vane 51 in the direction of its inoperative position, in other words anti-clockwise in FIG. 2. The position of the damper vane 51 and of the control piston 6 is determined by the deflection of the baffle plate 3 brought about according to the quantity of air drawn in. If the switch 72 is opened again, the valve body 60 of the drain valve 58 shuts off the outlet orifice 62 and the damping device 50 operates as a normal hydraulic damper. The fuel present in the trap 65 can now flow through the drain nozzle 67 and the line 68 into the fuel tank 37. In order to accelerate this outflow, it is expedient for the fuel tank 37 to be hermetically sealed and to be vented via the line 68, the drain nozzle 67, the trap 65 and the vent bore 70. As a result, the negative pressure which is created in the fuel tank 37 by the consumption of fuel rapidly produces evacuation of the trap 65, so ensuring that the trap 65 is empty whenever a cold start is required.

As an alternative to the drain nozzle 67, it is possible as shown in FIG. 2 to connect an overflow 80 to the trap 65, connecting with the line 68 through a passage 81 and a throttle bore 82. The throttle bore 82 may possibly be adjustable.

As mentioned, upon opening of the drain valve 58, the pivoting of the damper vane 51 produces a displacement of the control piston 6 resulting in the dispensing of a quantity of fuel which is too great in relation to quantity of indrawn air. In consequence, the enrichment of fuel needed for a cold start is automatically achieved. the magnitude of this enrichment is determined by corresponding dimensioning of the volume z of the trap 65 in proportion to the maximum volume of the second damper chamber 55. For automatic limiting of the duration of this period of enrichment, the switch 72 can be constructed as a time switch which opens automatically after the closure which occurs at a cold start, once a predetermined time has elapsed. Preferably, the switch 72 is constructed as a thermo time switch which senses engine temperature, closes at a selected temperature and remains closed until a predetermined engine temperature has been reached.

Figure 3:
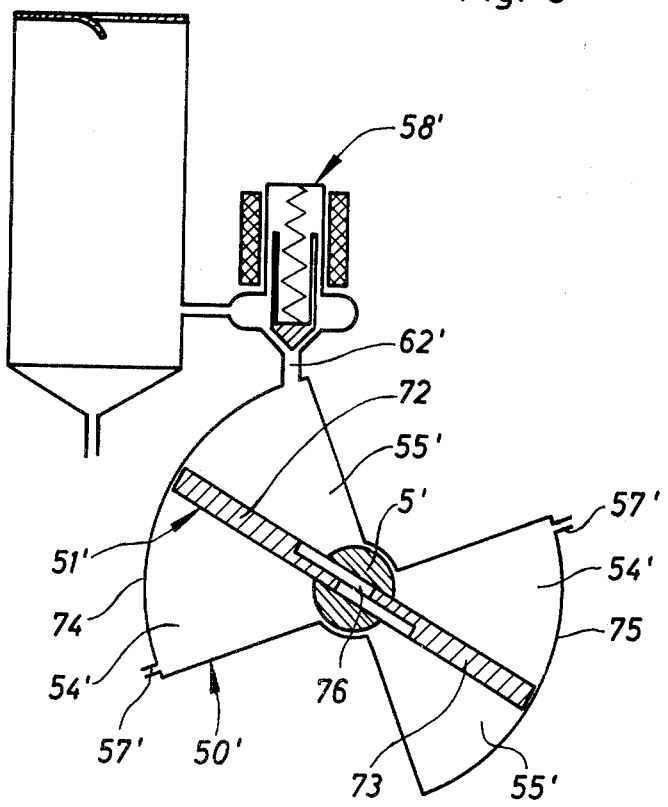
FIG. 3 is a diagrammatic side elevation of a modified form of damping device.

FIG. 3 shows a modification of the damping device shown in FIG. 2, in which the damping device 50' is provided with a two-vaned damping element 51', the vanes 72 and 73 of which are in each case pivotable in a housing 74 or 75 in the shape of a segment of a circle, and which in each case separate a first damper chamber 54' and a second damper chamber 55' from each other. As in the preceding example, the first damper chambers 54' are connected by connections 57' to the fuel pump 24 while the two second damper chambers 55' communicate with each other through a passage 76 in the damping element 51'. One of the second damper chambers 55' has an outlet orifice 62' which as in the case of the example of embodiment shown in FIG. 2 is controlled by the outlet valve 58'. The mode of action of this damping device is the same as that of the damping device shown in FIG. 2.

Many modifications of the examples of embodiment illustrated are possible without departing from the framework of the invention. For example, the damping vanes 72, 73 need not be diametrically located opposite each other as in FIG. 3; instead, they may be positioned at any angle to each other. Also, the invention can be applied to damping devices which contain damping elements other than the illustrated rotary vanes, for example piston dampers, or in general any damping elements which separate two damper chambers from each other.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A fuel injection system for a mixture compressing spark ignition internal combusion engine having means for injection of fuel into the air intake of the engine, comprising:

a fuel metering valve for dispensing to one or more injection jets a quantity of fuel related to the quantity of air flowing through said intake;

adjustable throttle valve in said air intake;

an air flow measuring element positioned within said intake, said measuring element being movable against a restoring force in accordance with the quantity of air flowing through said intake, said measuring element being arranged to actuate a control element of said fuel metering valve;

A damping device having a damping element connected to said measuring element;

two damping chambers having a throttling passage therebetween, said damping element being movable to displace fuel between said two damping chambers via said throttling passage;

a fuel pump connected to one of said damping chambers to provide fuel under pressure thereto, said fuel pump adapted for delivering fuel to said metering valve; and a discharge port connected to the second damping chamber via a thermally controlled outlet valve.

2. A fuel injection system as described in claim 1 further including a return line connected between said outlet valve and a fuel tank, and a trap chamber within said return line.

3. A fuel injection system as described in claim 1 wherein said outlet valve is adapted to be opened in the event of a cold start such that fuel pressure in the second damping chamber is diminished and the pressure in the first chamber causes movement of the damping element and thereby movement of said control element.

4. A fuel injection system according to claim 1, wherein said outlet valve is in the form of an electromagnetic valve, and including a thermal sensing time switch in the electrical circuit of said valve.

5. A fuel injection system according to claim 1, in which said damping device is in the form of a single valve damper arranged to pivot in a housing which is shaped like the segment of a circle.

6. A fuel injection system according to claim 1, in which said damping device includes a twin-vane damper, the vanes of which are each pivotally mounted in a housing which is shaped like a segment of a circle, and each of which separates first and second damping chambers, the two first damping chambers being connected to a fuel pump while the two second damping chambers are connected to said outlet valve.

7. A fuel injection system for a mixture compressing spark ignition internal combustion engine having means for injection of fuel into the air intake of the engine, comprising:

a fuel metering valve for dispensing to one or more injection jets a quantity of fuel related to the quantity of air flowing through said intake;

an adjustable throttle valve in said air intake;

an air flow measuring element positioned within said intake, said measuring element being movable against a restoring force in accordance with the quantity of air flowing through said intake, said measuring element being arranged to actuate a control element of said fuel metering valve;

a damping device having a damping element connected to said measuring element;

two damping chambers having a throttling passage therebetween, said damping element being movable to displace fuel between said two damping chambers via said throttling passage;

fuel pump connected to one of said damping chambers to provide fuel under pressure thereto, said fuel pump adapted for delivering fuel to said metering valve;

a discharge port connected to the second damping chamber via a thermally controlled outlet valve; and a trap chamber downstream of said outlet valve and provided with means for emptying said trap chamber after operation.

8. A fuel injection system according to claim 7, wherein the volume of said trap chamber is less than the maximum volume of said second damping chamber.

9. A fuel injection system for a mixture compressing spark ignition internal combustion engine having means for injection of fuel into the air intake of the engine, comprising:

a fuel metering valve for dispensing to one or more injection jets a quantity of fuel related to the quantity of air flowing through said intake;

an adjustable throttle valve in said air intake;

an air flow measuring element positioned within said intake, said measuring element being movable against a restoring force in accordance with the quantity of air flowing through said intake, said measuring element being arranged to actuate a control element of said fuel metering valve;

a damping device having a damping element connected to said measuring element;

two damping chambers having a throttling passage therebetween, said damping element being movable to displace fuel between said two damping chambers via said throttling passage;

a fuel pump connected to one of said damping chambers to provide fuel under pressure thereto, said fuel pump adapted for delivering fuel to said metering valve;

a discharge port connected to the second damping chamber via a thermally controlled outlet valve; and a trap chamber downstream of said outlet valve, said trap chamber having an overflow connected through a drain nozzle to a fuel tank.

* * * * *

UNITED STATES PATENT AND TRADEMARK OFFICE

CERTIFICATE OF CORRECTION

PATENT NO. : 4,174,693

DATED : November 20, 1979

INVENTOR(S) : Johannes Steinwart, Gerhard Maurhoff and Armin Bauder

It is certified that error appears in the above-identified patent and that said Letters Patent are hereby corrected as shown below:

Column 5, line 14, change "THe" to --the--;
line 66, change "the" to --The--;
line 67, delete "z" ;

Claim 1, column 6, line 52, before "adjustable", insert --an--;
line 59, change "A" to --a--;

Claim 7, column 8, line 3, before "fuel", insert --a--.

Signed and Sealed this

*Fifteenth* Day of *July 1980*

[SEAL]

*Attest:*

SIDNEY A. DIAMOND

*Attesting Officer*

*Commissioner of Patents and Trademarks*